United States Patent [19]

Mir et al.

[11] 4,112,437

[45] Sep. 5, 1978

[54] ELECTROGRAPHIC MIST DEVELOPMENT APPARATUS AND METHOD

[75] Inventors: José Manuel Mir, Webster; Jerry Reubon Varner, Fairport, both of N.Y.

[73] Assignee: Eastman Kodak Company, Rochester, N.Y.

[21] Appl. No.: 810,142

[22] Filed: Jun. 27, 1977

[51] Int. Cl.[2] ..... G03G 15/044

[52] U.S. Cl. ..... 346/159; 346/75

[58] Field of Search ..... 346/165, 159, 75; 355/3

[56] References Cited

U.S. PATENT DOCUMENTS

| | | | |
|---|---|---|---|
| 3,255,039 | 6/1966 | Dalton | 346/165 |
| 3,573,845 | 4/1971 | Gourdine | 346/159 |
| 3,660,087 | 5/1972 | Kaspaul | 346/159 |
| 3,725,951 | 4/1973 | McCurry | 346/159 |
| 4,019,188 | 4/1977 | Hochberg | 346/75 |
| 4,050,377 | 9/1977 | Watanabe | 346/75 |

FOREIGN PATENT DOCUMENTS

| | | | |
|---|---|---|---|
| 1,004,084 | 9/1965 | United Kingdom | 346/159 |

*Primary Examiner*—Jay P. Lucas
*Attorney, Agent, or Firm*—John D. Husser

[57] ABSTRACT

A mist of substantially-neutrally-charged, colorant-activating particles is deposited on a receiver in accordance with its interaction with an imagewise modulated ion stream. The deposited particle image is contacted with developer material to form a high density image.

18 Claims, 4 Drawing Figures

ELECTROGRAPHIC MIST DEVELOPMENT APPARATUS AND METHOD

CROSS-REFERENCE TO RELATED APPLICATIONS

Reference is made herein to commonly assigned U.S. application Ser. No. 805,216, entitled "Improved Electrographic Imaging Apparatus and Method" and filed June 9, 1977 in the name of Clark N. Kurtz.

BACKGROUND OF THE INVENTION

1. Field of the Invention

The present invention relates to electrographic imaging and more particularly to improved apparatus and techniques for use in mist development in electrographic imaging.

2. Brief Description of the Prior Art

In the early stages in evolution of electrographic copying and printing techniques, it was recognized that certain advantages pertain to development of latent electrographic images with small, airborne marking particles, e.g., in "liquid mist" or "powder cloud" form (hereinafter collectively referred to as "mists"). A primary advantage envisioned for mist development was the achievement of higher resolution development and thus better quality in fine line detail of graphic reproductions, or in half-tone and continuous tone reproductions.

Early systems seeking to obtain such advantages introduced a mist of electrostatically-charged marking particles between an image member, bearing an electrostatic image to be developed, and a development electrode which was spaced closely to the image bearing surface and connected to a source of potential. The electrical field thus created between the development electrode and the electrostatic image caused movement of the charged particles toward the image. However, commercialization of these early mist systems was impeded by the tendency of the charged marking particles to mutually repel one another and to attach to the supply conduit. These effects presented great difficulty in production and transport of a uniformly charged and concentrated mist. As a result, mist systems were not actively developed; and, at present, the most common commercial technique for developing latent electrostatic images on dielectric supports is by contacting such images with triboelectrically-charged marking particles, in mixture with a particulate or liquid carrier medium.

Recently, however, electrographic imaging and development systems have been disclosed which utilize a mist of substantially-neutrally-charged ink particles. In one such system the neutral-charge ink mist is introduced between a copy sheet (during its movement over an electrode) and an apertured or grid array which is electrically-biased according to the image pattern to be reproduced. The pattern-biased array modulates the passage of an ion stream located on the opposite side of the array from the copy sheet and directed toward the receiver. The ions that pass through the modulator charge ink particles in their path, and the charged particles are attracted toward, and deposit on, the receiver (see, e.g., U.S. Pat. No. 3,779,166).

Another recently developed approach using neutrally-charged ink mist is disclosed in copending U.S. application Ser. No. 805,216 entitled "Improved Electrographic Imaging Apparatus and Method" and filed June 9, 1977 in the name of Clark N. Kurtz. In that system, a mist of neutrally-charged ink particles is introduced between an image element having an electrical pattern to be developed and a predeterminedly-electrically-biased, ion control member. Upon directing a stream of ions through the control member and toward the mist, an imagewise-varying electrical field across the mist, viz., between the image element and the control member, controls charging of the mist particles and thus deposition of the particles on the image element. Such deposition is precisely in accordance with the outline of electrical pattern on the image element and in proportion to the relative magnitude of the pattern portions.

Both of the neutrally-charged ink mist systems described above have been demonstrated to provide useful results. However, it would be highly desirable, in some applications, to have images of density higher than has thus far been attainable by those systems. That is, both of the ink mist deposition systems described above have thus far been limited, in density attainable, by the atomization and covering characteristics of the ink solutions and particle dispersions. For example, an increase in concentration of colorant in the ink solvent has been found to increase the ink viscosity and thus reduce the atomization capabilities for the ink.

SUMMARY OF THE INVENTION

It is an object of the present invention to provide new procedure and apparatus for neutrally-charged mist imaging which will facilitate higher density in the copy image.

The inventive method and apparatus hereinafter described provide additional related advantages and thus related objects of the present invention are to provide reduced maintenance for the mist handling structures utilized, to facilitate use of a greater variety of materials in such mists, to minimize the quantity of mist required and to improve operative characteristics of mists, e.g., with respect to turbulence.

These objectives are obtained in accordance with the present invention by imagewise modulating an ion stream directed toward a receiver while flowing through the modulated stream, proximate the receiver, a mist of substantially-neutrally-charged, colorant-activating particles. The mist particles thus receive charge in accordance with the modulated ion stream and are deposited on the receiver in the desired image pattern and are contacted for reaction or other image-forming cooperation with developing material to form a high density image. In one preferred embodiment of the present invention, the receiver carries the pattern of colorant-activator for subsequent contact by a developing material. In another preferred embodiment the receiver itself carries developing material which is activated by the colorant-activating particles. The above and other preferred and advantageous embodiments of the invention are disclosed in the subsequent description.

BRIEF DESCRIPTION OF THE DRAWINGS

Illustrative preferred embodiments of the invention are hereinafter described with reference to the attached drawings which form a part hereof and in which.

DETAILED DESCRIPTION OF THE PREFERRED EMBODIMENTS

Figure 1:
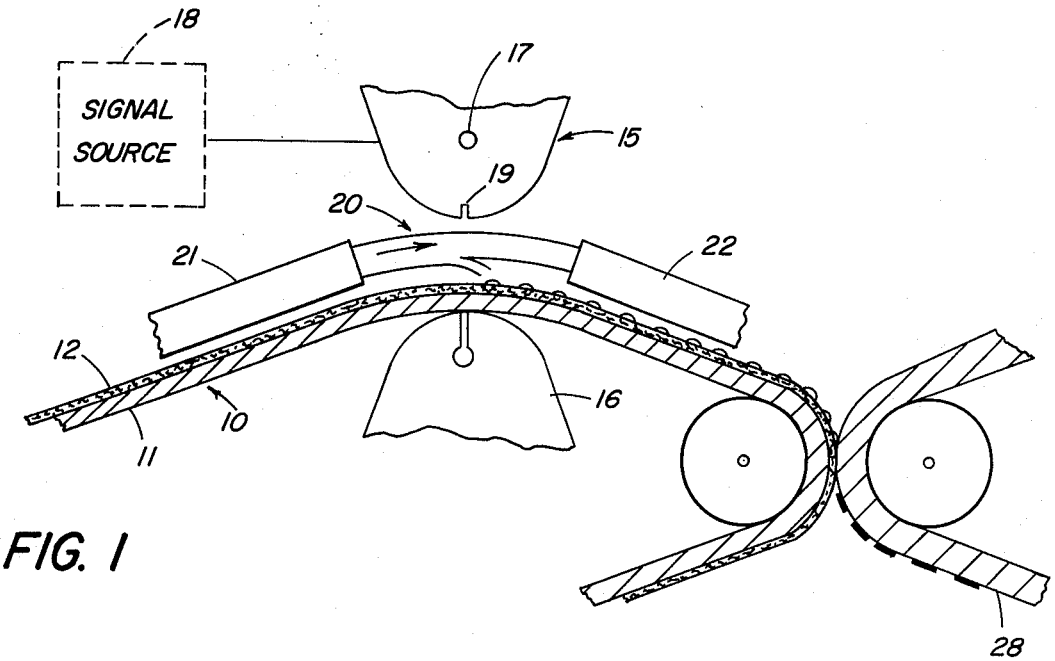
FIG. 1 is a schematic side view of a portion of an imaging apparatus for practicing one embodiment of the present invention.

Referring to FIG. 1, one embodiment useful in practice of the present invention is illustrated, this embodiment utilizing electronically-addressed aperture modulation and deposition of colorant-activating mist onto a receiver which itself carries the developing material. In this embodiment a receiver 10 is moved between an aperture array 15 and backbar 16. The array 15 comprises a pluralitya of apertures 19 formed through a laminate structure which can comprise a dielectric layer between two conductive layers. The apertures collectively extend across the width of the receiver and each aperture is selectively electrically-addressable to provide an ion blocking or enhancing fringe field. Backbar 16 is maintained at a potential which creates an electrical field toward receiver 10 with regard to ions generated by source 17. Signal source 18 addresses the apertures selectively to "off" or "on" conditions in synchronism with movement of the receiver and in accordance with the image pattern to be created. The signal source can be active, e.g., addressed by a bank of photocells scanning a document to be reproduced, or a memory, e.g., magnetic discs. A more complete description of the construction and operation of such an aperture ion-modulating device is set forth in U.S. Pat. Nos. 3,689,935 and 3,863,261.

During movement of the receiver 10 part the modulating device, a mist of colorant-activating particles, designated generally 20, is flowed between the apertures 19 the receiver from source 21 to sump 22. Illustrative structure and procedure for generating substantially-neutrally-charged mists are disclosed in U.S. Pat. No. 3,779,166. In practice, it is found useful to provide a protective air stream flowing between the apertures and the mist.

As will be hereinafter described in more detail, various colorant-activator/developer combinations are useful in accordance with the present invention. In the disclosed embodiment the receiver can comprise a plastic film support 11, e.g., Mylar film, having coated thereon a layer 12 of dry ink which is soluble with the activator, e.g., a 30% concentration Orasol Orange RLN-diethyl carbitol ink. For such a receiver the mist 20 can comprise atomized solvent. As shown in FIG. 1, after passing the modulating array the receiver 12 moves downstream, carrying the deposited colorant-activator image pattern to a location where it is moved into pressure contact with copy sheet material 28 such as plain paper. As illustrated, the activated developer material is transferred to the web. Specifically, where dissolved by deposition of the solvent in accordance with the image pattern addressed on the aperture array, the ink is transferred onto the paper.

Exemplary parameters for operation using the embodiment just described are:

Atomization Rate— 1.5 cc/min. (diethyl carbitol)
Backbar Voltage— 6 KV
Receiver and Paper Speed— 50 cm/sec.
Mist Air Flow— 116 cc/sec. at 50 cm/sec.
Protective Air Flow— 50 cc/sec. at 50 cm/sec.

Another exemplary colorant-activator/developer combination which has been found useful in the FIG. 1 embodiment comprises a receiver 10 having a plastic film support 11 bearing an ink layer 12 having the following composition:

50%—Piccolastic C100 (low molecular weight polystyrene)
40%—P-cymene
4%—Carbon pigment
6% Polyvinyl toluene methacrylate lithium methacrylate methacrylic acid (PVT)

P-cymene developer is atomized and deposited on the receiver as described so that the polymer pigment combination will be softened and subsequently transferred to plain paper.

In the systems described above image densities of 2.0 can be readily achieved, this being significantly higher than densities attainable with conventional ink mist printing.

Figure 2:
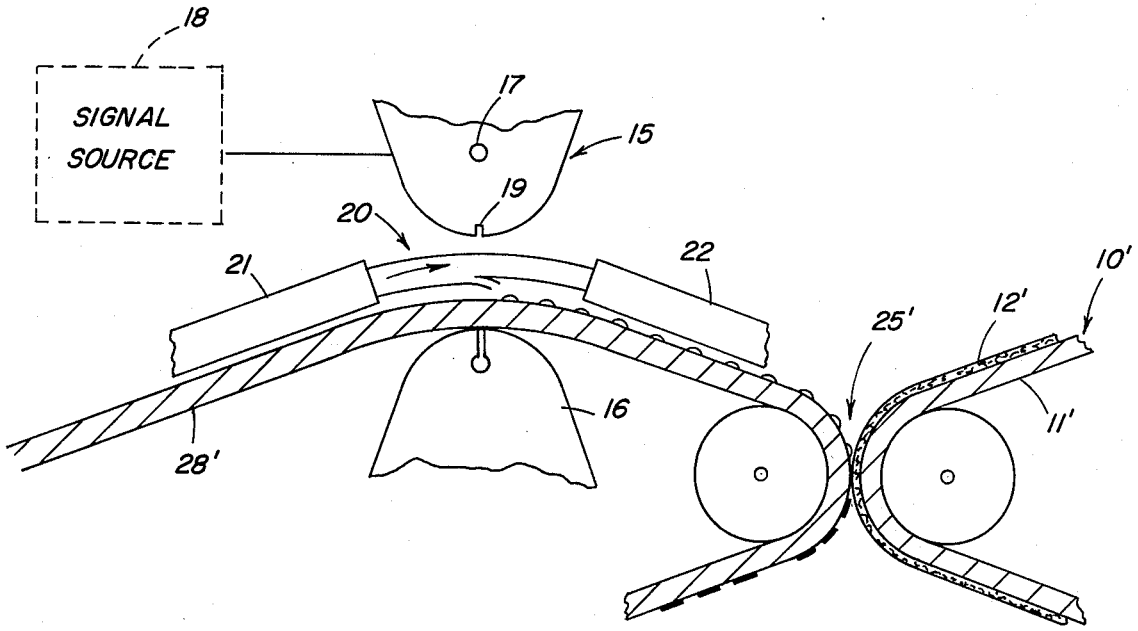
FIG. 2 is a schematic side view of an apparatus similar to that shown in FIG. 1 but modified for practice of another embodiment of the present invention.

FIG. 2 illustrates another embodiment for practice of the present invention which, by comparison with the FIG. 1 apparatus, can be seen to be the same except fo the interchange of the developer-bearing element and the copy sheet. Thus, in the FIG. 2 apparatus, the colorant-activator 20 is deposited directely on the copy sheet 28' in a pattern corresponding to the signals from source 18, and the copy sheet moved downstream into contact with developer layer 12' of element 10'. The colorant-activator carried on the copy sheet effects activation of the developer so that it is transferred to the copy sheet. Developer 12' can be, e.g., the same dry ink described above with respect to FIG. 1 and the copy sheet 28' can be a plain paper, e.g., Newton Falls CIS paper. Using these materials in the FIG. 2 configuration and with the solvent mist and other parameters described above with respect to FIG. 1, image densities of 2.0 can be obtained on the copy sheet.

Figure 3:
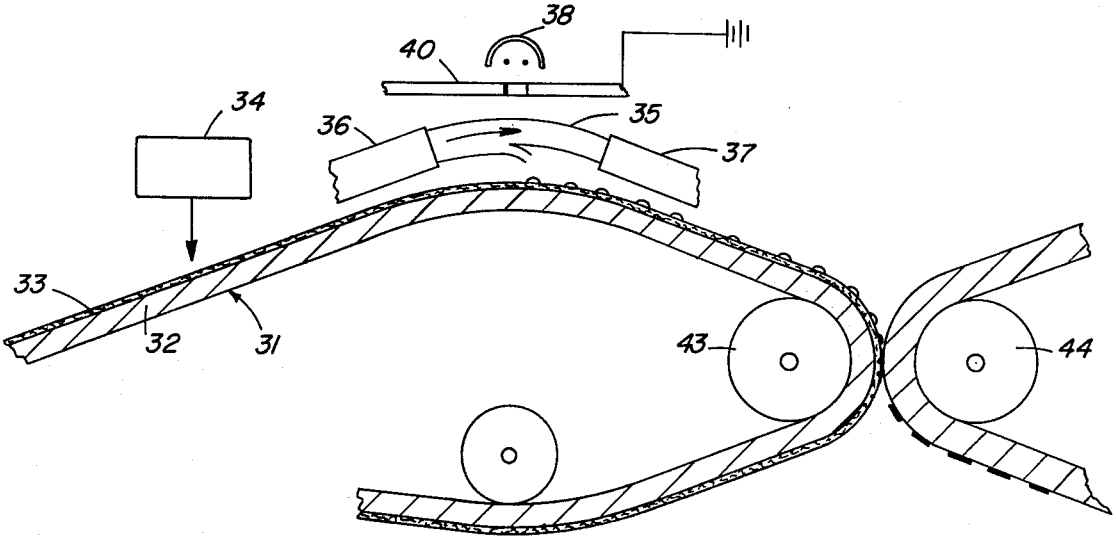
FIG. 3 is a schematic side view of another imaging apparatus for practice of another embodiment of the present invention.

FIG. 3 illustrates another structural embodiment for practice of the present invention. In this embodiment ion modulation is effected in accordance with the teachings of aforementioned U.S. application Ser. No. 805,216 and colorant-activator is deposited on a receiver which carries both a latent electrostatic image and the developer. The receiver 31 in this embodiment comprises a support 32 which carries a developer layer 33. The receiver member is constructed to be capable of retaining an electrostatic charge pattern which is applied at recording station 34, e.g., a conventional multi-stylus electrostatic recorder. Activator mist 35 is flowed over receiver 31 from source 36 to sump 37 in the same manner described above with respect to FIGS. 1 and 2. However, the ions from corona source 38 are modulated by the imagewise-varying field between the biased slit-defining plate 40 and the electrostatic image on receiver 31, instead of by an electrically-addressed aperture array such as shown in FIGS. 1 and 2.

The relative potentials of source 38, plate 40 and the image on receiver 31 are explained in detail in said U.S. application Ser. No. 805,216, which is incorporated herein by reference. Briefly explained, the bias on plate 40 is of magnitude such that the field between the receiver 31 and the plate 40 causes movement of ions passing through the slit to be toward the plate or toward the receiver, depending on the charge pattern carried on the receiver portions then passing beneath the slit. When ions are attracted toward the receiver 31, they intersect and charge the colorant-activating mist particles which, in turn, deposit on the receiver in accordance with the charge pattern. After movement downstream from the ion source and modulating device, the activated developer 33 is transferred from receiver 31 to a copy sheet 42 which is fed in pressure contact with the receiver, between rollers 43 and 44 and at substantially the same rate of movement.

Figure 4:
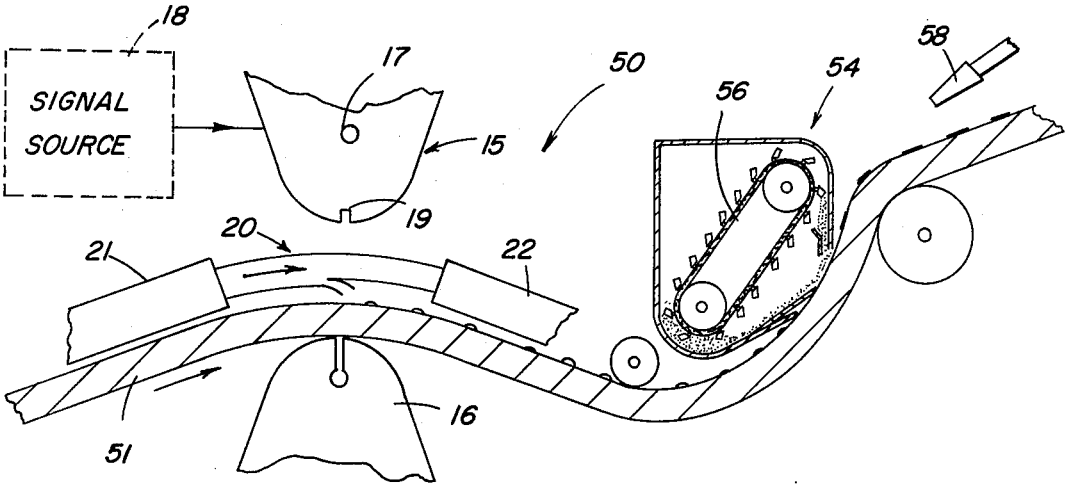
FIG. 4 is a schematic side view of still another imaging apparatus useful in accordance with the present invention.

FIG. 4 discloses yet another embodiment for practice of the present invention. This embodiment uses the electronically-addressed aperture array described above, i.e., elements 15–22 are the same as described with regard to FIG. 1. In this embodiment, receiver 51 for the colorant-activating mist is the copy sheet. Downstream from the location of colorant-activator deposition, a developer station 54 is provided, which in this embodiment, comprises a supply of powder which is cascaded across a surface of the colorant-activator bearing receiver, e.g., by a conventional xerographic cascade development conveyor 56. It will be appreciated that other commonly used electrographic toner applicators, e.g., brush applicators or powder cloud applicators, could be used. After the development station an air jet 58 is provided to clean unattached powder. If needed the air can be heated to further fix adhered powder or a subsequent fixing station, e.g., an infrared heater, can be provided. The several examples described below illustrate parameters useful in the practice of this embodiment of the invention. In these examples, the paper speed was 20 inches per second, the mist and lip flow speeds were also approximately 20 inches per second, the corona voltage was 5 KV and the backbar voltage was negative 6.5 KV.

Acetophenone was atomized using a commerically available Devilbiss atomizer operating at a dial setting of 5. The acetophenone colorant-activator was deposited in image pattern on plain paper (Newton Falls ClS) by means of the aperture array 15. The colorant-activator image on the paper was then developed with cascaded Kodak Ektaprint toner. The unattached toner was removed by a high speed air gun and the developed image was fixed using a high temperature air gun.

In another example the same colorant-activator, acetophenone, was deposited onto Kromekote 1 Side Lithographic White 60# paper having a coating of Piccolastic C100 resin (acetophenone soluble). Developer was applied as in the previous example; however, no subsequent fixing was required.

As a further example the acetophenone was applied to each of the papers in the manner described in the previous two examples, and Orasol Orange RLN was cascaded thereover as the developer. The images did not require subsequent fixing in either case.

Considering the foregoing it will be apparent that the important aspects for colorant-activator/developer materials are: (1) that the colorant-activator be capable of forming a neutrally-charged mist and be electrostatically chargeable upon interaction with an ion stream for attraction toward the receiver medium and (2) that the colorant-activator/developer materials in combination interact to produce a high density visible image. Although the colorant-activator materials specifically disclosed herein are solvents for the developer materials, it will be appreciated that other colorant-activator/developer combinations can be utilized. For example the colorant-activator can be a chemical reactant or catalyst for combination with reactant(s) in the developer.

It will also be appreciated that various other modifications can be made in the disclosed means and method for implementing the invention. For example, the activator could be applied, by one of the modes described, to an intermediate web, transferred to a developer web which is then contacted with paper. Also it will be appreciated that the FIG. 1 and 3 apparatus could be combined in implementing the invention, e.g., by forming an electrostatic image with the aperture array device shown in FIG. 1 (on a charge-retentive support) and imagewise applying colorant-activator in accordance with that electrostatic image on the support with the ion modulating means of the FIG. 3 apparatus. However, it is to be noted that we have found that increased image density and improved image sharpness or resolution are provided in modes of operation wherein a minimum of transfers occur.

The invention has been described in detail with particular reference to certain preferred embodiments thereof, but it will be understood that variations and modifications can be effected within the spirit and scope of the invention.

What is claimed is:

1. A method of electrographic imaging comprising the steps of:

(a) modulating a stream of ions directed toward an imaging zone in accordance with an image pattern;

(b) flowing a mist of substantially-neutrally-charged colorant-activating particles over said imaging zone and through said ion stream;

(c) moving a receiver through said imaging zone in synchronization with the modulation of said ion stream so that colorant-activating particles can deposit thereon in said image pattern; and (d) providing a developer for contacting deposited particles and for cooperating with such particles to form a developed image pattern.

2. The invention defined in claim 1 wherein the receiver is a copy member, said colorant-activator particles are deposited on the copy member and developer is thereafter contacted with the deposited particle pattern to form a visible image on the copy member.

3. The invention defined in claim 1 wherein the colorant-activator particles are deposited on a receiver which bears a uniform layer of developer.

4. The invention defined in claim 3 wherein the developed image pattern formed by cooperation of said particles and said developer is transferred from said receiver to a copy member to provide a visible image.

5. The invention defined in claim 1 wherein said receiver bears an electrostatic image pattern which cooperates in modulating said ion stream.

6. The invention defined in claim 1 wherein said colorant-activating particles comprise a solvent and said developer is an electrographic toner applied to said receiver after deposition of said particles.

7. A method of electrographic imaging comprising the steps of:

(a) moving a paper support over an electrode at an imaging zone;

(b) directing a stream of ions from a source toward said electrode;

(c) imagewise modulating the passage of ions from said source to said electrode with an array of electrically-addressed, ion-control apertures;

(d) flowing a substantially-neutrally-charged mist of colorant-activating particles over the successive portions of said support which pass through said imaging zone so that said particles are deposited on said support in an image pattern controlled by said ion modulation; and (e) moving said support into contact with developer to render the image pattern visible.

8. The invention defined in claim 7 wherein said developer is a soluble ink layer on a carrier and said colorant-activating particles comprise a solvent for said ink.

9. A method of electrographic imaging comprising the steps of:

(a) moving a support bearing a uniform layer of developer material over an electrode at an image station;

(b) directing a stream of ions from a source toward said electrode;

(c) imagewise modulating the passage of ions from said source to said support by means of an intermediate array of electrically-addressed, ion-control apertures (d) directing a mist of substantially-neutrally-charged, colorant-activation particles over the successive portions of said support passing through the imaging zone whereby said particles are deposited on said support in an image pattern corresponding to said ion modulation; and (e) moving the successive portions of said support bearing said deposited particles into pressure contact with a copy member to effect transfer to said copy member of a visible image pattern corresponding to said ion modulation.

10. Electrographic imaging apparatus of the type having an imaging station, said apparatus comprising:

(a) electrode means located at said image station;

(b) means for moving a copy member over said electrode means;

(c) means for directing a stream of ions toward said electrode means;

(d) means, located intermediate said directing means and such copy member, for modulating passage of ions to the support in response to received signals;

(e) means for signalling said modulating means in synchronism with movement of such copy member and in accordance with an image pattern to be reproduced;

(f) means for flowing a mist of substantially-neutrally-charged, colorant-activating particles over portions of the copy member at said image station; and (g) means located downstream from said image station for contacting colorant-activating particles on the copy member with developer material.

11. Electrographic imaging apparatus of the type having an imaging station, said apparatus comprising:

(a) electrode means located at said image station;

(b) a support comprising a layer of developer material;

(c) means for moving said support over said electrode means;

(d) means for generating a stream of ions toward said electrode means;

(e) means, located intermediate said support and said generating means, for modulating passage of ions to said support in response to received signals;

(f) means for signalling said modulating means in synchronism with movement of said support and in accordance with an image pattern to be reproduced;

(g) means for directing a mist comprising substantially-neutrally-charged, colorant-activating particles over portions of said support passing said image station; and (h) means located downstream from said image station for moving a copy member into synchronous pressure contact with said support to effect transfer of an activated developer pattern from said support to the copy member.

12. Electrographic imaging apparatus comprising:

(a) an imaging member having a charge-retentive surface;

(b) means for moving said member along an operative path;

(c) means located along said path for forming an electrostatic image on said member;

(d) means, located along said path downstream from said image forming means, for directing a stream of ions toward the successive portions of said member moving therepast;

(e) electrode means, located intermediate said ion directing means and said member and including an elongated aperture, for imagewise modulating the flow of ions toward said member in accordance with the image on said member;

(f) means for directing a mist of substantially-neutrally-charged, colorant-activating particles between said member and electrode means; and (g) means, located along said path downstream from said electrode means, for uniformly contacting said member with developer material.

13. Electrographic imaging apparatus of the type having an imaging station, said apparatus comprising:

(a) electrode means located at said image station;

(b) means for moving a copy member over said electrode means;

(c) means for directing a stream of ions toward said electrode means;

(d) means, located intermediate said directing means and such copy member, for modulating passage of ions to the copy member in response to received signals;

(e) means for signalling said modulating means in synchronism with movement of the copy member and in accordance with an image pattern to be reproduced;

(f) means for flowing a mist of substantially-neutrally-charged, adhesive particles over portions of the copy member at said image station; and (g) means located downstream from said image station for contacting deposited adhesive particles on the copy member with particulate marking material.

14. Electrographic imaging apparatus comprising:

(a) means for moving an image member along an operative path;

(b) means for directing a stream of ions toward such member at a first location on said path;

(c) means for imagewise modulating the passage of such ions to such member;

(d) means for flowing a mist of substantially-neutrally charged colorant-activating particles between such image member and said ion source; and (e) developing means for cooperating with particles which have passed to said web to form a developed image.

15. The invention defined in claim 14 wherein said developing means is disposed as a layer on said image member.

16. The invention defined in claim 14 wherein said developing mens is located along said path at a location downstream from said ion source.

17. The invention defined in claim 14 wherein said modulating means comprises:

(1) means for forming an electrostatic image on said image member at a location upstream from said ion source; and (2) an electrically-biased plate defining an aperture between said ion source and said image member.

18. The invention defined in claim 14 wherein said modulating means comprises:

(1) a plate defining a plurality of discrete apertures extending across said path;

(2) means for selectively energizing portions of said plate to control passage of ions through said apertures in accordance with received signals; and (3) means for signalling said energizing means in accordance with a pattern to be reproduced.

* * * * *